United States Patent [19]

Watanabe et al.

[11] Patent Number: 4,558,593

[45] Date of Patent: Dec. 17, 1985

[54] FAILURE DETECTION SYSTEM FOR HYDRAULIC PUMPS

[75] Inventors: Hiroshi Watanabe; Eiki Izumi, both of Ibaraki, Japan

[73] Assignee: Hitachi Construction Machinery Co., Ltd., Tokyo, Japan

[21] Appl. No.: 634,560

[22] Filed: Jul. 26, 1984

[30] Foreign Application Priority Data

Jul. 29, 1983 [JP] Japan ..... 58-137618
Jul. 29, 1983 [JP] Japan ..... 58-137619
Aug. 1, 1983 [JP] Japan ..... 58-139502

[51] Int. Cl.[4] ..... G01M 19/00
[52] U.S. Cl. ..... 73/168; 417/63
[58] Field of Search ..... 73/168

[56] References Cited

U.S. PATENT DOCUMENTS 4,171,638 10/1979 Coman et al. ..... 73/168 X
4,368,638 1/1983 Groves et al. ..... 73/168
4,464,931 8/1984 Hendrick ..... 73/168

*Primary Examiner*—Daniel M. Yasich
*Attorney, Agent, or Firm*—Antonelli, Terry & Wands

[57] ABSTRACT

A failure detection system for hydraulic pumps each having displacement varying means. The system includes displacement command generating means for generating a command value for causing the displacement varying means of one of the pumps to be displaced a predetermined amount, sensor means for sensing the amount of a displacement of the displacement varying means, comparator means for comparing the absolute value of the difference between a command value generated by the displacement command generating means and the amount of the displacement sensed by the sensor means with a predetermined allowable value, and output means for outputting a failure signal for indicating that the pump is out of order when it is found by the comparator means that the allowable value has been exceeded by the absolute value.

7 Claims, 21 Drawing Figures

FAILURE DETECTION SYSTEM FOR HYDRAULIC PUMPS

BACKGROUND OF THE INVENTION

This invention relates to a failure detection system for hydraulic pumps which are now widely in use to provide a source of hydraulic fluid for hydraulic machines and apparatus, including hydraulic excavators, cranes, etc.

A hydraulic pump is one of the most important elements of hydraulic excavators, cranes and other hydraulic machines and apparatus for producing hydraulic energy, and a deterioration of its performance due to a technical failure or a change occurring with time adversely affects the reliability in operation of a machine and apparatus for which it serves as a source of power. Thus, it is necessary to check the hydraulic pump for its performance. A system of the prior art for checking hydraulic pumps to detect their technical failures and a deterioration of performance (hereinafter referred to as failures) will be discussed.

A variable displacement type hydraulic pump which is to be monitored to detect its failure by the system of the prior art comprises displacement varying means (hereinafter referred to as a swash plate) and is connected to a regulator so as to operate the swash plate in accordance with its discharge pressure. The system of the prior art for detecting a failure of the hydraulic pump comprises a hydraulic pressure tester which comprises a pressure gauge for measuring the hydraulic pressure, a flowmeter for measuring the flow rate of a hydraulic fluid, and a manually operated variable throttle for throttling the discharge line of the variable displacement hydraulic pump to raise the dischage pressure. The variable displacement hydraulic pump is also connected to a device for measuring the rpm. of the pump.

To detect a failure of the variable displacement hydraulic pump, a line connected to the discharge side of the pump is cut off and the pump is connected at the discharge side to an inlet of the hydraulic pressure tester via a line, such as a hydraulic hose, while an outlet of the hydraulic pressure tester is connected to a hydraulic fluid reservoir via a line, such as a hydraulic hose. Then, the variable displacement hydraulic pump is driven by a prime mover, such as an engine, and the rpm. N of the pump is measured by the device for measuring the rpm. of the pump. While the pump is in this condition, the variable throttle of the hydraulic pressure tester is actuated to throttle the discharge line until the value of the pressure gauge (discharge pressure of the variable displacement hydraulic pump) becomes equal to a reference pressure $P_{ref}$ set beforehand. The discharged hydraulic fluid volume Q of the pump obtained at this time is measured by the flowmeter. In this case, the actual discharged hydraulic fluid volume is decided by the position of the swash plate which is controlled by the regulator in accordance with the discharge pressure of the pump. Then, a theoretical discharged hydraulic fluid volume $Q_{ref}$ is calculated based on the rpm. N and reference pressure $P_{ref}$. Finally, the discharged hydraulic fluid volume Q measured beforehand is compared with the theoretical discharged hydraulic fluid volume $Q_{ref}$, and when the difference between them exceeds an allowable value, the pump is found to be out of order.

The system for detecting a failure of a hydraulic pump of the prior art of the aforesaid construction has some disadvantages, although it is possible for it to detect a failure. In checking the pump, it is necessary to cut off a part of the hydraulic fluid piping and connect a hose and a hydraulic pressure tester to the pump. This operation is time-consuming, and there is the risk of dust and other foreign matter being incorporated in the hydraulic fluid in cutting off the piping. Checking the pump requires operation of the variable throttle and reading the pressure gauge and flow meter. This operation is also time-consuming and troublesome. Moreover, in the case of a hydraulic machine and apparatus, such as a hydraulic excavator of a large size, a multiplicity of hydraulic pumps are provided. In this case, it is time-consuming and troublesome to identify, when it is known that some of them are out of order but it is not known which ones have failed, the failed pumps.

SUMMARY OF THE INVENTION

This invention has been developed for the purpose of obviating the aforesaid disadvantages of the prior art. Accordingly, the invention has as its object the provision of a failure detection system for hydraulic pumps capable of detecting a failure automatically and readily without requiring the operation of cutting off hydraulic fluid piping and connecting a hydraulic pressure tester and simultaneously detecting failures of a plurality of hydraulic pumps.

To accomplish the aforesaid object, the invention provides a failure detection system for hydraulic pumps each having displacement varying means, comprising displacement command generating means for generating a command value for causing the displacement varying means of one of the pumps to be displaced a predetermined amount, sensor means for sensing the amount of a displacement of the displacement varying means, comparator means for comparing the absolute value of the difference between the command value generated by the displacement command generating means and the amount of the displacement sensed by the sensor means with a predetermined allowable value, and output means for outputting a failure signal for indicating that the pump is out of order when it is found by the comparator means that the allowable value has been exceeded by the absolute value.

The failure detection system according to the invention may further comprise limiter means for limiting the changing rate of the command value generated by the displacement command generating means to a level below the maximum displacement rate of the displacement varying means, and wherein the comparator means have inputted thereto a command value that has passed through the limiter means.

Alternatively, the failure detection system may further comprise delay means operative to produce a final failure signal only when the output signal of the output device is continuously produced longer than a predetermined period of time.

DESCRIPTION OF THE PREFERRED EMBODIMENTS

Figure 1:
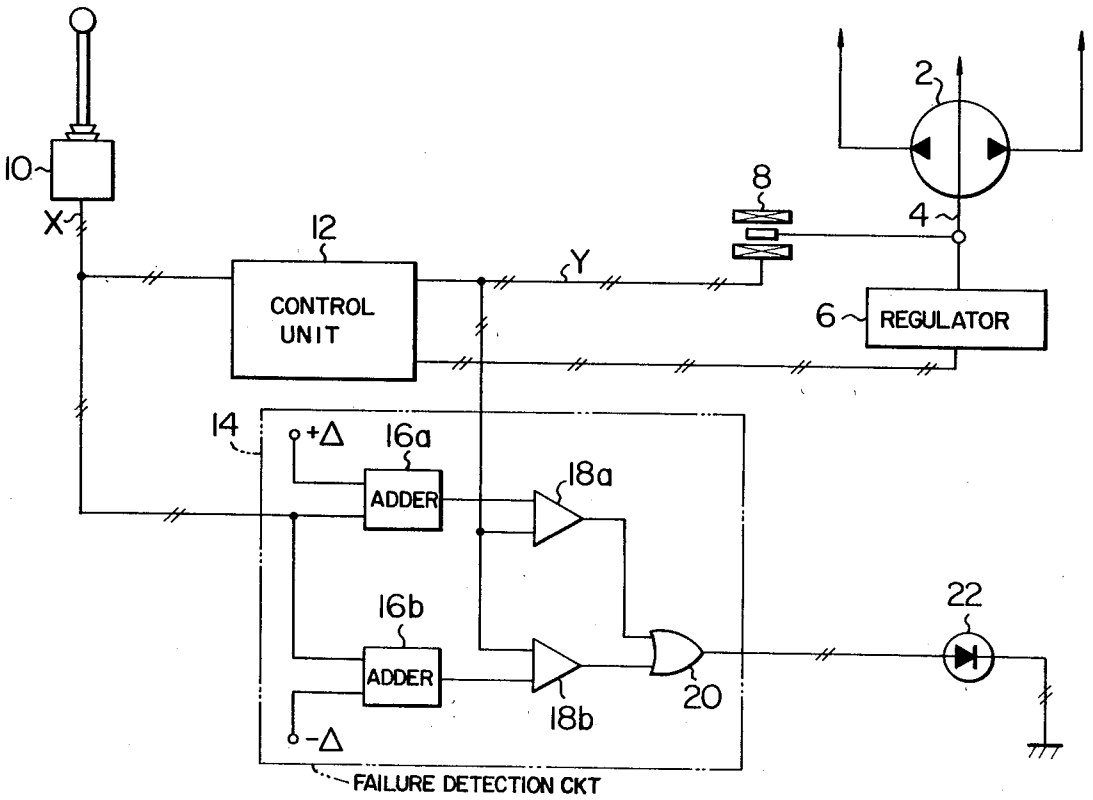
FIG. 1 is a block diagram of the failure detection system for hydraulic pumps comprising a first embodiment of the invention.

The first embodiment of the failure detection system for hydraulic pumps in conformity with the invention will be described by referring to FIG. 1. The reference numeral 2 designates a variable displacement hydraulic pump of both-direction tilting type (hereinafter simply hydraulic pump or pump in the interest of brevity) which forms an objective for detecting failures. The pump 2 comprises displacement varying means 4, such as a swash plate, tilting shaft, etc., which will be represented by a swash plate in the following description. The swash plate 4 is driven by a regulator or a swash plate drive 6 in accordance with an input signal, and its position or displacement is sensed by a displacement meter 8. The pump 2 is driven by an operation lever 10. The displacement meter 8 outputs a displacement signal Y conforming to a displacement that has been sensed, and the operation lever 10 outputs an operation signal X conforming to the manipulated variable. The signal Y of the displacement meter 8 and the signal X of the operation lever 10 are inputted to a control unit 21 for controlling the displacement of the swash plate 4 in accordance with the actuation of the operation lever 10. The control unit 12 calculates the difference between the two signals X and Y or (X−Y) and produces a signal corresponding to the difference which is inputted to the swash plate drive 6, to thereby drive the swash plate 4 in conformity with the operation of the operation lever 10. As the swash plate 4 is actuated by following up the operation of the operation lever 10 and the output signal Y of the displacement meter 8 for sensing the displacement of the swash plate 4 becomes equal to the output signal X of the operation lever 10, the control unit 12 outputs a stop signal to the swash plate drive 6.

The numeral 14 designates a failure detection circuit for detecting a failure of the pump 2 comprising two addition circuits 16*a* and 16*b*, two comparators 18*a* and 18*b* and an OR circuit 20. The addition circuit 16*a* performs addition of the signal X to a predetermined allowable value Δ subsequently to be described, and the addition circuit 16*b* performs subtraction of the allowable value Δ from the signal X (or addition of −Δ to X). The comparator 18*a* compares the value obtained as a result of the addition performed by the adder 16*a* with the signal Y and produces a signal when the signal Y exceeds the value obtained by the addition. The comparator 18*b* compares the result of the subtraction outputted by the adder 16*b* with the signal Y and produces an output when the signal Y is less than the value obtained by the subtraction. The OR circuit 20 which has signals of the comparators 18*a* and 18*b* inputted thereto produces a signal when either one of the comparators 18*a* and 18*b* produces an output. The OR circuit 20 has a light emitting diode 22 connected thereto which emits light as the OR circuit 20 produces an output signal.

The allowable value Δ will now be described. In a structure, such as a swash plate of a hydraulic pump, wobbling of the parts might occur and the swash plate drive mechanism might lack precision. Thus, the operation signal X and displacement signal Y would usually be prevented from being completely in agreement with each other, with a difference being produced therebetween. If the wobbling of the parts were in a certain range, no trouble would occur in the operation of the hydraulic pump and it would not be necessary to decide this as a failure. Thus, the difference between the two signals X and Y which is attributed to the wobbling in a certain range is treated as the allowable value Δ and excluded from the failures. The allowable value Δ may vary depending on the hydraulic pump.

Operation of the embodiment shown in FIG. 1 will be described by referring to FIGS. 2(*a*)–2(*c*). Actuation of the operation lever 10 drives the swash plate 4 in accordance with the difference between the operation signal X and displacement signal Y, so that the movement of the swash plate 4 follows up the movement of the operation plate 10. Meanwhile, the operation signal X is inputted to the addition circuit 15*a* of the failure detection circuit 14 and added to the allowable value Δ. The value obtained by the addition or (X+Δ) is compared with the displacement signal Y at the comparator 18*a*. When the signal Y exceeds the value (X+Δ), the comparator 18*a* produces a high-level output "1", as shown in FIG. 2(*a*). Namely, when the signal Y is below the value (X+Δ), the comparator 18*a* produces a low-level output "0", but when the signal Y exceeds the value (X+Δ) to become Y>(X+Δ), the comparator 18*a* produces an output "1". The fact that the signal Y exceeds the value (X+Δ) indicates that the pump 2 has a failure which is more serious than wobbling. The output "1" of the comparator 18*a* therefore indicates that the pump 2 has a failure.

The operation signal X is inputted to the addition circuit 16*b*, too, and the allowable value Δ is substracted therefrom. The value obtained by subtraction (X−Δ) is compared with the displacement signal Y at the comparator 18*b*. As shown in FIG. 2(*b*), the comparator 18*b* produces an output "0" when Y≧(X−Δ) and an output "1" when Y<(X−Δ). By comparing the displacement signal Y with the values obtained by the addition and subtraction at the comparators 18*a* and 18*b*, respectively, as described hereinabove, or by comparing the absolute value of the difference between the two signals Y and X with the allowable value Δ, it is possible to detect all the failures manifesting themselves as the behaviours of the swash plate 4. Since the outputs of the comparators 18*a* and 18*b* are inputted simultaneously to the OR circuit 20, the OR circuit 20 outputs a signal "1" when either one of the comparators 18*a* and 18*b* outputs a signal "1", to cause the light emitting diode 22 to emit light. More specifically, in normal cases where the swash plate 4 is controlled following up the operation signal X produced by the operation lever 10, the displacement signal Y is in the range $X-\Delta \leqq Y \leqq X+\Delta$ so that the OR circuit 20 produces no output and the light emitting diode 22 remains inoperative. When the pump 2 fails and the swash plate 4 is put out of order, the displacement signal Y is out of the range $X-\Delta \leqq Y \leqq X+\Delta$ and the OR circuit produces an output to render the light emitting diode 22 operative, indicating that the pump 2 has failed.

In place of the light emitting diode 22, any known indicator or alarm may be used or they may be used in combination. Also, the output of the OR circuit 20 may be used either singly or in combination with an indicator or alarm to drive emergency pump shutdown means or operate a failure monitor device.

Accordingly, in the embodiment shown and described hereinabove, two addition circuits, two comparator circuits and an OR circuit are used, and the value obtained by adding an allowable value to the operation signal and the value obtained by subtracting the allowable value from the operation signal are compared with the displacement signal, to produce a signal when the displacement signal is out of the predetermined range to indicate that the pump is out of order. Thus, it is possible to detect a failure of the pump automatically and promptly at all times without requiring to cut off the hydraulic fluid piping and attaching a tester to the pump and without the risk of foreign matter being incorporated in the hydraulic fluid circuit.

Figure 2A:
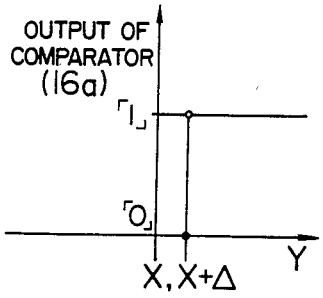
FIGS. 2(*a*), 2(*b*) and 2(*c*) are diagrams showing output characteristics of the comparator circuit and OR circuit shown in FIG. 1.
Figure 2B:
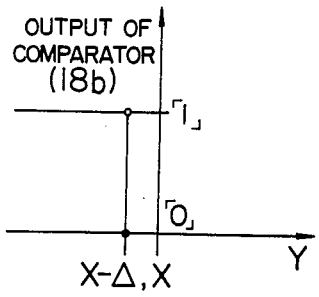
Figure 2C:
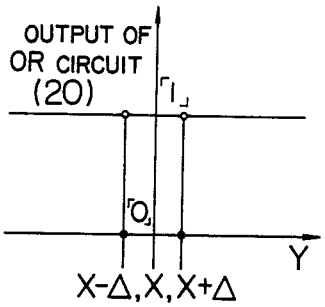
Figure 3:
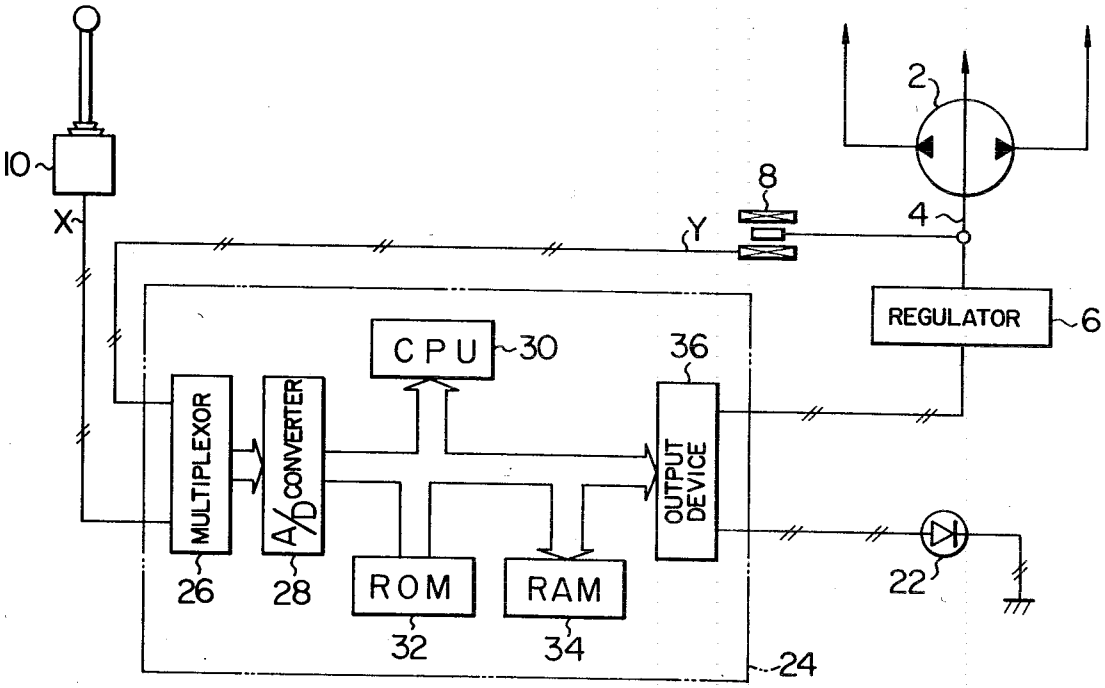
FIG. 3 is a block diagram of the failure detection system comprising the first embodiment shown in FIG. 1 as being worked by using a microcomputer.

FIG. 3 shows the first embodiment of the failure detection system for hydraulic pumps shown in FIG. 1 as worked by using a microcomputer. In the figure, parts similar to those shown in FIG. 1 are designated by like reference characters. The numeral 24 designates a control unit provided by using a microcomputer which inputs the operation signal X and displacement signal Y and outputs a swash plate control signal to the swash plate drive 6 and a failure signal to the light emitting diode 22. The control unit 24 has the functions of the control unit 12 and failure detection circuit 14 and comprises a multiplexor 26 for inputting the signals X and Y by switching them, an A/D converter 28 for converting the signals X and Y to digital representation, a central processing unit (CPU) 30 for performing predetermined operations based on the signals X and Y, a read-only memory (ROM) 32 for storing the procedures of the operations to be performed by the CPU 30, a random-access memory (RAM) 34 for temporarily storing inputted data and values obtained by calculations, and an output device 36 for outputtting signals obtained by calculations and control to the swash plate drive 6 and light emitting diode 22.

Figure 5:
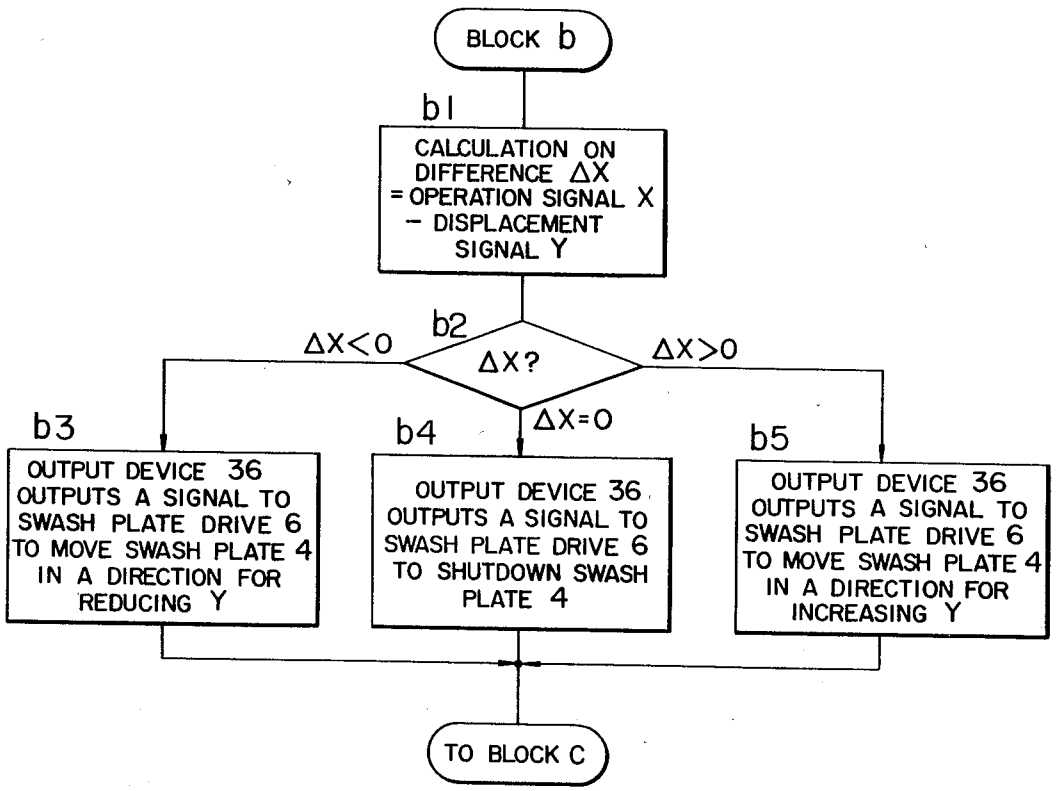
FIGS. 5 and 6 are flow charts showing the detailed procedures of the blocks b and c of the flow chart shown in FIG. 4.
Figure 6:
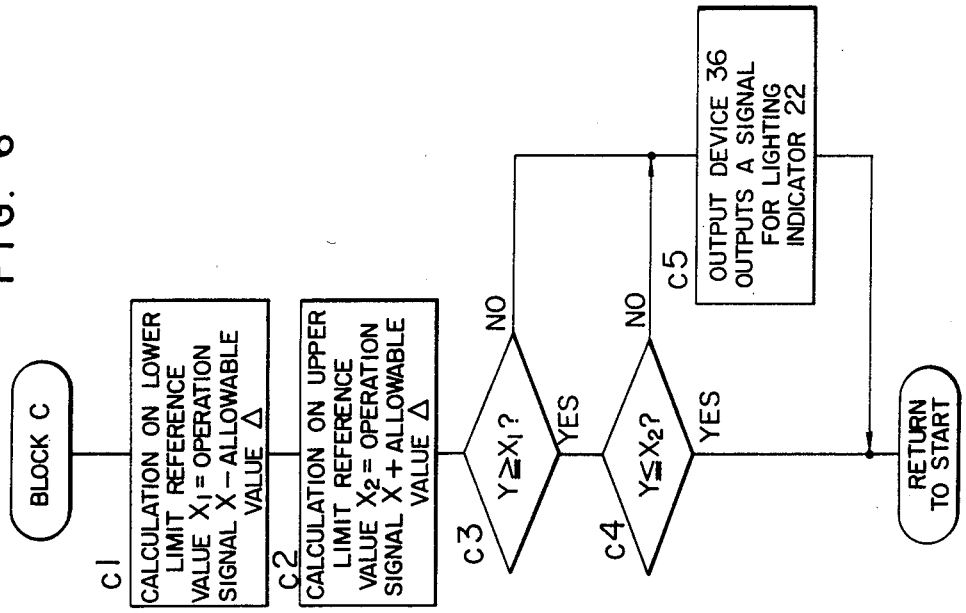

Operation of the failure detection system shown in FIG. 3 will be described by referring to the flow charts shown in FIGS. 4–6. First, the operation signal X and displacement signal Y are stored in the RAM 34 via the multiplexor 26 and A/D converter 28 (block a of FIG. 4). Then, control of the swash plate drive 6 is effected (block b of FIG. 4). The detailed procedures of the control are shown in FIG. 5. In block b, the difference ΔX between the operation signal X and displacement signal Y or $\Delta X=X-Y$ is calculated (block $b_1$), and whether the difference ΔX is positive, negative or 0 is found (block b2). If the difference X is negative, then the output device 36 outputs a signal for reducing the displacement of the swash plate 4 to the swash plate drive 6 (block b3). If the difference ΔX is 0, then a signal for stopping the swash plate 4 is outputted (block b4). If the difference ΔX is positive, then a signal for increasing the displacement of the swash plate 4 is outputted (block b5). In this way, normal swash plate control is effected in blocks a and b.

Figure 4:
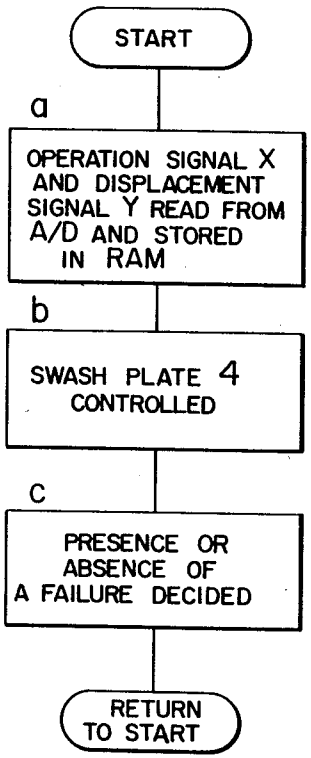
FIG. 4 is a flow chart showing the operation of the control unit of the failure detection system shown in FIG. 3.

Then, whether or not the pump 2 has a failure is detected (block c of FIG. 4). The detailed procedures of block c are shown in FIG. 6. In block c, the allowable value Δ described by referring to the first embodiment is subtracted from the operation signal X, to obtain a lower limit reference value $X_1$ ($X_1=X-\Delta$) which is stored in the RAM 34 (block c1). The lower limit reference value $X_1$ corresponds to the value obtained by subtracting the allowable value Δ from the operation signal X in the first embodiment. Thereafter, the allowable value Δ is added to the operation signal X to obtain an upper limit reference value $X_2$ ($X_2=X+\Delta$) which is stored in the RAM 34 (block c2). The upper limit reference value $X_2$ corresponds to the value obtained by adding the allowable value Δ to the operation signal X described by referring to the first embodiment which is an output of the addition circuit 16*a*. The displacement signal Y and lower limit reference value $X_1$ stored in the RAM 34 are retrieved and whether or not the signal Y is above the lower limit reference value $X_1$ is decided (block c3). When the signal Y is above the lower limit reference value $X_1$, the operation shifts to block c4 in which the signal Y and upper limit reference value $X_2$ are retrieved from the RAM 34 and whether or not the signal Y is below the upper limit reference value $X_2$ is decided. When the signal Y is below the upper limit reference value $X_2$, the operation returns to block a and the aforesaid procedures are followed again. When the signal Y is found to be below the lower limit reference value $X_1$ in block c3 or when the signal Y is found to be above the upper limit reference value $X_2$ in block c4, the output device 36 outputs a failure signal and causes the light emitting diode 22 to emit light (block c5). Thereafter, the operation returns to block a and the same procedures are performed again.

The failure signal produced by the output device 36 may be used to actuate the indicator, alarm, emergency pump shutdown means and failure monitor device in the same manner as described by refering to the first embodiment.

Accordingly, in the failure detection system shown in FIG. 3, the swash plate drive 6 for driving the swash plate 4 is controlled by using a microcomputer and the operation signal X and displacement signal Y are used in such a manner that the lower limit reference value and upper limit reference value are obtained by using the operation signal X and the allowable value Δ and compared with the displacement signal Y. When the displacement signal is below the lower limit reference value or above the upper limit reference value, a signal is outputted to indicate that the pump 2 is out of order. Thus, it is possible to detect a failure of the pump automatically and promptly at all times without requiring to cut off the hydraulic fluid piping and attaching a tester to the pump and without the risk of foreign matter being incorporated in the hydraulic fluid circuit. The use of a microcomputer makes it possible to successively handle a multiplicity of hydraulic pumps in the same manner, so as to detect the failures of a multiplicity of pumps in one operation.

Figure 7:
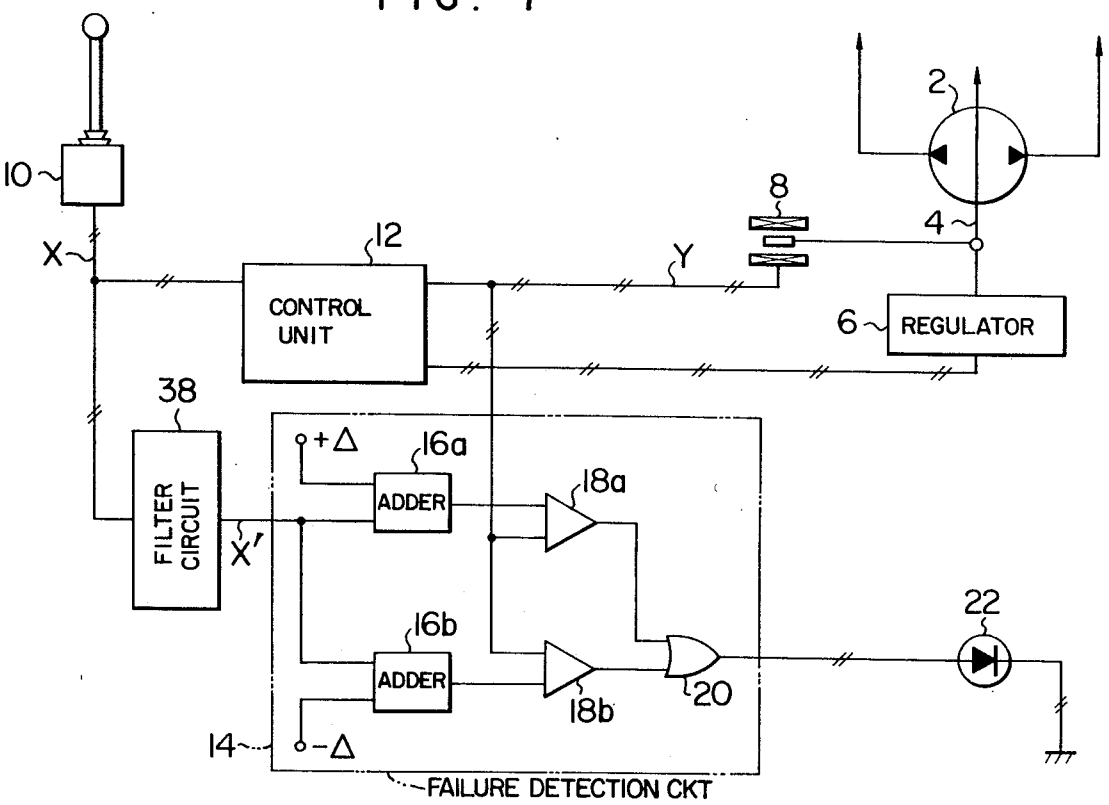
FIG. 7 is a block diagram of the failure detection system for hydraulic pumps comprising a second embodiment.

FIG. 7 shows a second embodiment of the failure detection system for hydraulic pumps in conformity with the invention. In the figure, parts similar to those shown in FIG. 1 are designated by like reference characters. The reference numeral 38 designates a filter circuit connected to the operation lever 10 which has the functions of rendering the rise of the operation signal X gentle if it is sharp when the signal X is outputted and allowing the operation signal X to be outputted as it is when its rise is blow a predetermined value. The filter circuit 38 produces an output signal which is fed to the failure detection circuit 14 as a checking operation signal X'.

Figure 8:
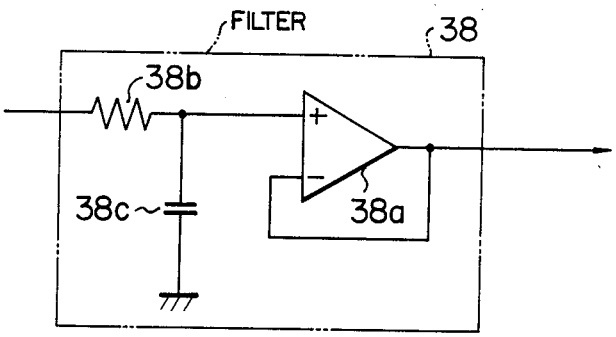
FIG. 8 is a circuit diagram of the filter circuit.

Referring to FIG. 8, the filter circuit 38 is composed of an operational amplifier 38*a*, a resistance element 38*b* having a resistance R, and a capacitor 38*c* having a capacitance C. This circuit is a low band-pass filter which cuts signals of frequencies higher than those determined by 1/CR. The value of CR is decided by the maximum speed of the swash plate 4.

The reason why the filter circuit 38 is provided is as follows. The operation lever 10 is manipulated by the operator and the speed of its operation may vary depending on the occasions. When the speed of operation is low, the rise of the operation signal X is gentle and the swash plate 4 is able to follow up the rise of the signal X immediately. However, when the speed of operation is high, the rise of the operation signal becomes sharp (the signal X has a high rate of change), and the swash plate 4 is unable to follow up the operation, resulting in a slight time lag of actuation of the swash plate 4 behind the production of the operation signal X. When this is the case, the delay in the actuation of the swash plate 4 manifests itself in the displacement signal Y. Thus, the failure detection circuit 14 which compares the signals X and Y with each other produces a failure signal during the time the swash plate 4 is delayed in being actuated, even if the delay is a very short period. The filter circuit 38 is intended to eliminate the production of a failure signal by mistake when the actuation of the swash plate 4 has such a time delay behind the production of the operation signal X. The time constant of the filter circuit 38 is set in such a manner that the rate of change of the operation signal X is restricted to a value below the maximum rate of displacement of the swash plate 4. Thus, the operation signal X of the operation lever 10 changes to the checking operation signal X' having a rate of change below the maximum rate of displacement of the swash plate 4 as it passes through the filter circuit 38.

The checking operation signal X' outputted by the filter circuit 38 is inputted to the addition circuits 16*a* and 16*b* of the failure detection circuit 14. Operations performed after the signal X' is inputted to the addition circuits 16*a* and 16*b* are as described by referring to the first embodiment with regard to the operation signal X inputted to the failure detection circuit 14 shown in FIG. 1. That is, the comparator 18*a* produces a low level output "0" when $Y \leqq (X'+\Delta)$ and a high level output "1" when $Y > (X'+\Delta)$; the comparator 18*b* produces a low level output "0" when $Y \geqq (X'-\Delta)$ and a high level output "1" when $\bar{Y} < (\bar{X}'-\Delta)$; and the OR circuit produces a high level output "1" except when $X'-\Delta \leqq Y \leqq X'+\Delta$ to render the light emitting diode 22 operative to emit light, indicating that the pump 2 is out of order.

The output of the OR circuit 20 may be used to drive the emergency shutdown means for the pump 2 either singly or in combination with the indicator and alarm, as is the case with the first embodiment. When the output of the OR circuit 20 is used for driving the emergency pump shutdown means, the provision of the filter circuit 38 for avoiding the inadvertent production of a failure signal is particularly advantageous because it is possible to avoid shutdown of the pump 2 when no failure has occurred.

Accordingly, in the second embodiment of the invention, the failter circuit 38 is connected to the failure detection circuit 14 to allow the checking operation signal X' to be inputted to the failure detection circuit 14. This is conductive to prevention of a failure signal from being produced due to the delay in the actuation of the swash plate 4*b* behind the production of the operation signal X. Thus, in this embodiment, it is only when the pump 2 is mechanically or functionally out of order that a failure signal is produced.

The second embodiment of the failure detection system in conformity with the invention may be worked by using a microcomputer in the same manner as the first embodiment. When the second embodiment is worked in this way, the control unit including the microcomputer is similar to the control unit 24 shown in FIG. 3 in construction except that the control unit of this embodiment also has the functions of the control unit 12, failure detection circuit 14 and filter circuit 38 shown in FIG. 7.

Operation of the control unit of the embodiment using the microcomputer will be described by referring to flow charts shown in FIGS. 9 and 10. First, the operation signal X and displacement signal Y are inputted to a RAM via a multiplexor and an A/D converter (block a of FIG. 9). Then, the drive for the swash plate 4 is controlled (block b of FIG. 9). The details of the procedures followed in effecting this control are the same as those of the procedures described by referring to FIG. 5 with regard to the first embodiment.

Figure 9:
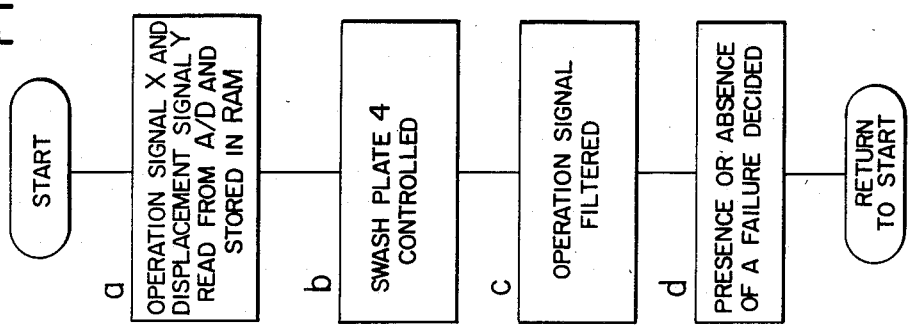
FIG. 9 is a flow chart of the operation of the control unit of the second embodiment of the failure detection system for hydraulic pumps in conformity with the invention as worked by using a microcomputer.
Figure 10:
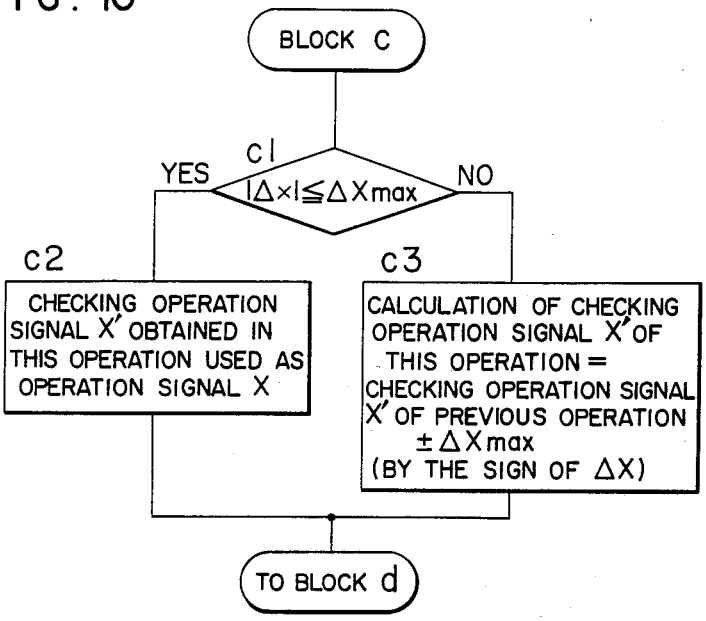
FIG. 10 is a flow chart of the detailed procedures of the block c shown in the flow chart in FIG. 9.

Let us now describe the procedures followed in block c shown in FIG. 9. In block c, the function of the filter circuit 38 shown in FIG. 8 is performed, and the details thereof are shown in FIG. 10. Namely, in block c1, the difference $\Delta X$ calculated in block b1 shown in FIG. 5 is retrieved from the RAM, and its absolute value $|\Delta X|$ is compared with a value $\Delta X_{max}$ which is an upper limit value set based on the maximum rate of displacement of the swash plate 4. Assume that the time required for following the procedures in block a to block b is denoted by t. Then, the rate of a rise of the operation signal X is $\Delta X/t$ and the maximum rate of displacement of the swash plate 4 is substantially $\Delta X_{max}/t$. Thus, to limit the rate of the rise of the operation signal X to a level below the maximum rate of displacement of the swash plate 4, it is necessary to first compare the difference $\Delta X$ with the upper limit value $\Delta X_{max}$. This comparison takes plaace in block c1. When it is found in block c1 that the absolute value $|\Delta X|$ of the difference $\Delta X$ is below the upper limit value $\Delta X_{max}$, the operation signal X inputted in block a is used as the checking operation signal X' as it is (block c2). When it is found in block c1 that the absolute value $|\Delta X|$ of the difference $\Delta X$ exceeds the upper limit value $\Delta X_{max}$, the upper limit value $\Delta X_{max}$ is added to or subtracted from the checking operation signal X' obtained in the preceding operation depending on the direction of tilting of the swash plate 4 to provide a value which is used as a checking operation signal X' for operation being performed (block c3).

Then, in block d shown in FIG. 9, whether or not the pump 2 is out of order is decided. The details of the procedures followed in block d are similar to those of the procedures shown in FIG. 6 and described by referring to the first embodiment except that the operation signal X of blocks c1 and c2 is replaced by the checking operation signal X' obtained in block c as shown in FIG. 10. That is, calculation is done on the lower limit reference value $X_1$= checking operation signal X'− allowable value Δ and the upper limit reference value $X_2$= checking operation signal X'+ allowable value Δ, and thereafter, the same procedures as those of the procedures c3, c4 and c5 shown in FIG. 6 are followed.

It is the same as in the case of the embodiment shown in FIG. 7 that when the failure signal produced as an output from the output device is used for actuating emergency pump shutdown means, the use of a filter circuit for processing the signal can achieve satisfactory results.

Accordingly, when the embodiment described is worked by using a microcomputer, the operation signal X is processed through a filter circuit, and this is conducive to prevention of the production of a failure signal due to the time delay in the actuation of the swash plate behind the production of an operation signal, making it possible to detect only such failures as those occurring in normal operation of the hydraulic pump.

Figure 11:
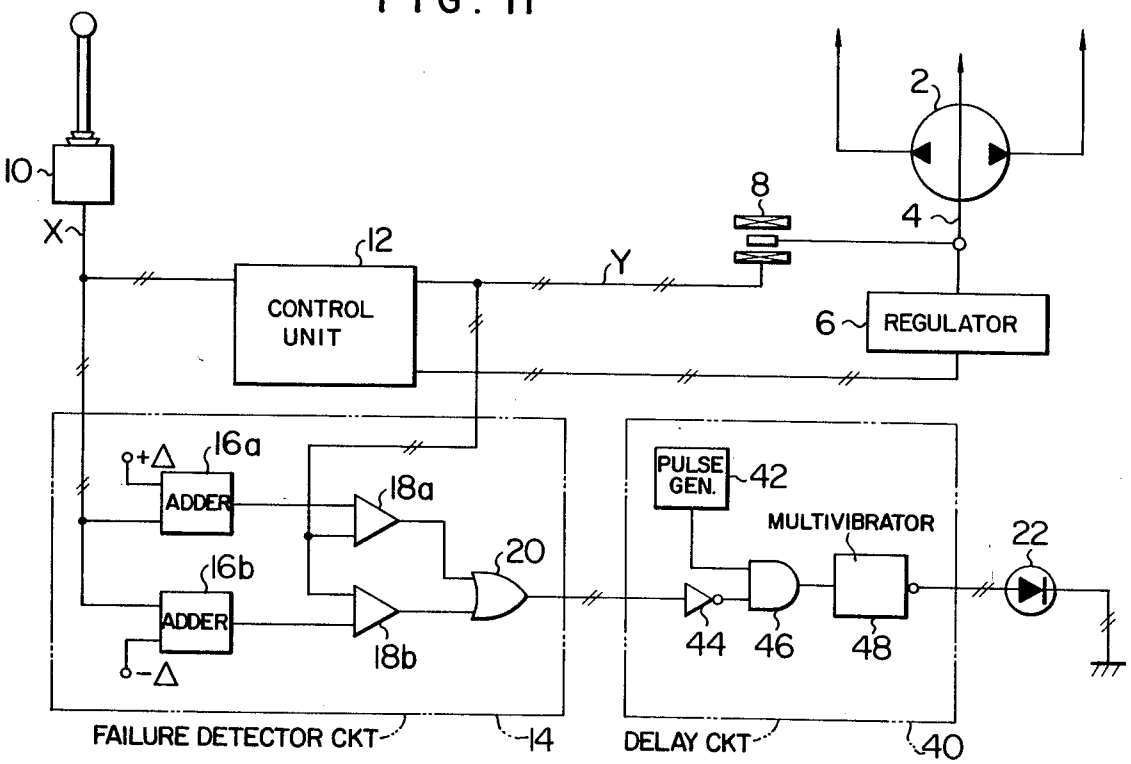
FIG. 11 is a block diagram of the failure detection system for hydraulic pumps comprising a third embodiment.

FIG. 11 shows a third embodiment of the failure detection system for hydraulic pumps in conformity with the invention. In the figure, parts similar to those shown in FIG. 1 are designated by like reference characters. The numeral 40 designates a delay circuit which has a signal from the failure detection circuit 14 inputted thereto and produces a final failure signal only when the signal from the failure detection circuit 14 lasts over a predetermined period of time. The delay circuit 40 is composed of a pulse generating circuit 42, a NOT circuit 44 for inverting the signal from the failure detection circuit 14, an AND circuit 46 having pulses produced by the pulse generating circuit 42 and an output signal of the NOT circuit 40 inputted thereto, and a triggerable monostable multivibrator 48 for triggering an output signal of the AND circuit 46. The triggerable monostable multivibrator 48 operates such that when a trigger signal is inputted thereto, its output becomes a low level signal "0", for example and, after lapse of a predetermined period of time, the output becomes a high level signal "1", and has a characteristic such that when a trigger signal is inputted thereto again during the predetermined period of time, the output of the low level signal "0" lasts for the predetermined period of time after the trigger signal is inputted. The light emitting diode 22 is rendered operative by the high level signal "1" of the triggerable monostable multivibrator 48 and emits light, indicating that the pump 2 is out of order.

The reason why the delay circuit 40 is provided is the same as the reason why the filter circuit 38 is connected to the failure detection circuit 14 in the second embodiment shown in FIG. 7.

Figure 12:
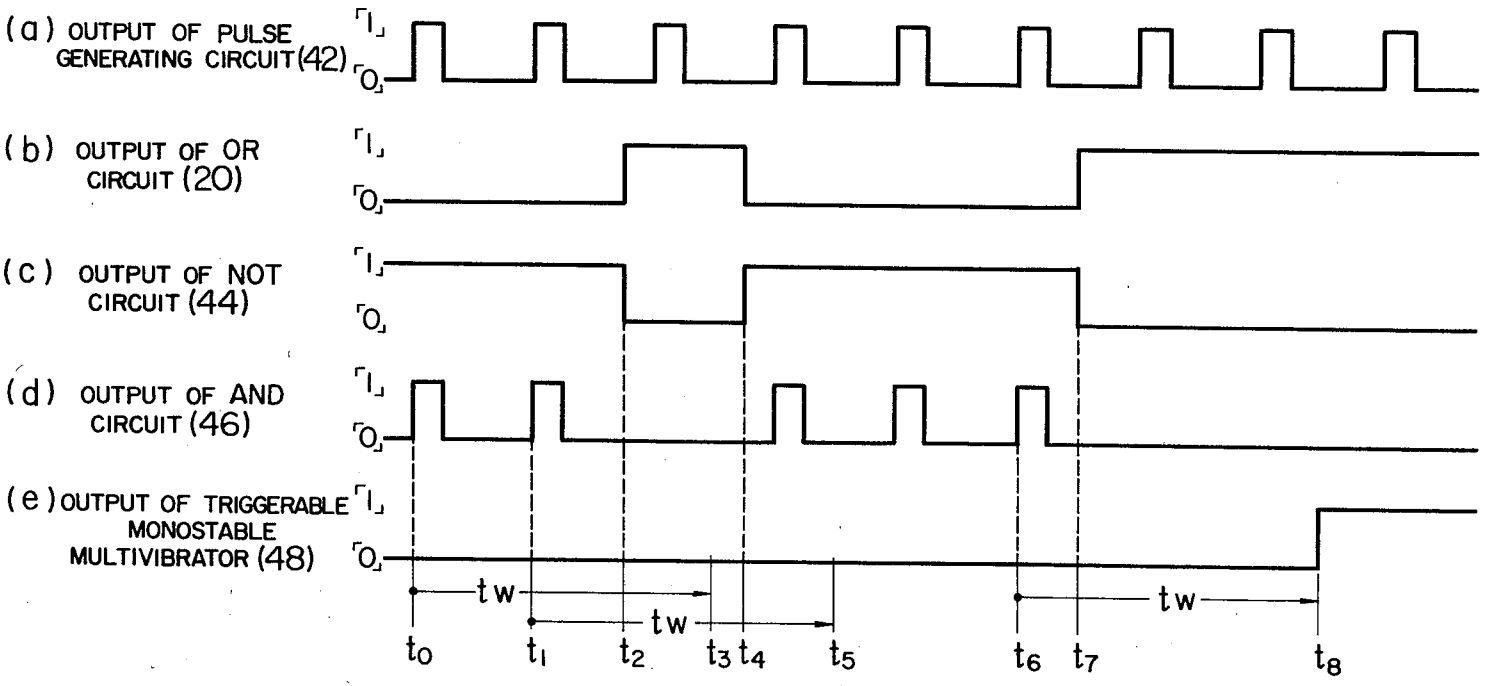
FIGS. 12(*a*), 12(*b*), 12(*c*), 12(*d*) and 12(*e*) are time charts in explanation of the operation of the delay circuit shown in FIG. 11.

Operation of the delay circuit 40 will be described by referring to FIG. 12. The output of the OR circuit 20 is inputted to the NOT circuit 44 of the delay circuit 40 and changed to an inverted signal. FIG. 12(*b*) shows the output signal of the OR circuit 20, and the output signal of the NOT circuit 44, which is an inverted signal of the output signal of the OR circuit 20, is shown in FIG. 12(*c*). Meanwhile, the pulse generating circuit 42 produces pulses of a predetermined period as shown in FIG. 12(*a*), and the pulses generated by the pulse generating circuit 42 and the output of the NOT circuit 44 are inputted to the AND circuit 46 which produces an output shown in FIG. 12(*d*). Assume that at a time $t_c$, the operation signal X, displacement signal Y and allowable value Δ are related as follows: $Y \leqq X+\Delta$. In this case, the OR circuit 20 and NOT circuit 44 output "0" and "1" respectively, so that the AND circuit 46 produces a pulse as it is generated by the pulse generating circuit 42. By the rise of the pulse from the AND circuit 36 at the time $t_0$, the output of the triggerable monostable multivibrator 48 becomes "0". This state lasts for a period of time $t_w$. If the relation $Y \leqq X+\Delta$ still holds at a time $t_l$, then a pulse is outputted again from the AND circuit 46. The period of time $t_w$ is set to be longer than the interval of the pulses produced by the pulse generating circuit 42, so that at the time $t_1$, the triggerable monostable multivibrator 48 still produces an output "0". As the pulse is inputted again at the time $t_1$, the output of the triggerable monostable multivibrator 48 is kept in the state of "0" for an additional period of $t_w$ which starts at the time $t_1$. Assume that the operation lever 10 is suddenly actuated at a time $t_2$ when the triggerable monostable multivibrator 48 is in the aforesaid state, and that the swash plate is unable to follow up the operation of the operation lever 10. Then, the relation $Y \leqq X+\Delta$ does not hold any longer and the relation $Y > X+\Delta$ holds. This relation only lasts between times $t_2$ and $t_4$ if the swash plate 4 is able to follow up the operation of operation lever 10 at the time $t_4$. Thus, during this period of time, the OR circuit 20 and NOT circuit 44 produce "1" and "0", respectively, as outputs, and the AND circuit 46 does not output the pulse from the pulse generating circuit 42, so that the triggerable monostable multivibrator 48 is not triggered. However, the period of time $t_w$ lasts from the time $t_1$ to a time $t_5$, so that during this period of time, the output of the triggerable monostable multivibrator 48 is kept in a state of "0" even if no pulse is inputted thereto. As the swash plate 4 follows up the operation of the operation lever 10 at the time $t_4$, the operation signal X, displacement signal Y and allowable value Δ have the relation $Y \leqq X+\Delta$ again, so that the output of the NOT circuit 44 becomes "1". Because of this, the triggerable monostable multivibrator 48 is triggered by a pulse outputted from the AND circuit 46 immediately after the time $t_4$ is passed. Thus, the period of time $t_w$ starts again at the time the triggerable monostable multivibrator 48 is triggered. After all, by setting the period of time $t_w$ at a suitable level, it is possible to keep the failure signal from being produced to cause the light emitting diode 22 to emit light, even if there is a slight delay in the swash plate 4 following up the operation of the operation lever 10.

If the pump 2 fails at a time $t_7$, then the relation $Y > X+\Delta$ holds between the operation signal X, displacement signal Y and allowable value Δ and this relation lasts. Thus, the OR circuit 20 and NOT circuit 44 produce outputs "1" and "0", respectively, and no pulses are inputted to the triggerable monostable multivibrator 48. Consequently, the output of the triggerable monostable multivibrator 48 is kept in a state of "0" for the period of time $t_w$ from a time $t_6$ at which a pulse is inputted immediately before the time $t_7$ until a time $t_8$. However, after the time $t_8$ is passed, the output of the triggerable monostable multivibrator 48 becomes "1" and this state lasts so long as the failure of the pump 2 lasts. Therefore, the light emitting diode 22 continues to emit light, indicating that the pump 2 is out of order.

When the output of the delay circuit 40 is used for driving emergency pump shutdown means, the provision of the delay circuit 40 is advantageous as is the case with the embodiment shown in FIG. 7, because it makes it possible to avoid unnecessary shutdown of the pump 2.

Accordingly, in the embodiment shown and described hereinabove, the delay circuit 40 is connected to the failure detection circuit 14, so that a final failure signal is produced to indicate that the pump 2 is out of order only when a failure signal outputted by the failure detection circuit 14 is continuously produced. This makes it possible to avoid the production of a failure signal temporarily due to a failure of the swash plate to follow up the operation of the operation lever 10 and produce a failure signal only when the pump 2 is mechanically or functionally out of order.

The third embodiment of the failure detection system for hydraulic pumps in conformity with the invention shown in FIG. 11 can also be worked by using a microcomputer as is the case with the first and second embodiments. In this case, the construction of a control unit including the microcomputer is similar to that of the control unit 24 shown in FIG. 3, except that the control unit also has the functions of the control unit 12, failure detection circuit 14 and delay circuit 40 of the third embodiment shown in FIG. 11.

Figure 15:
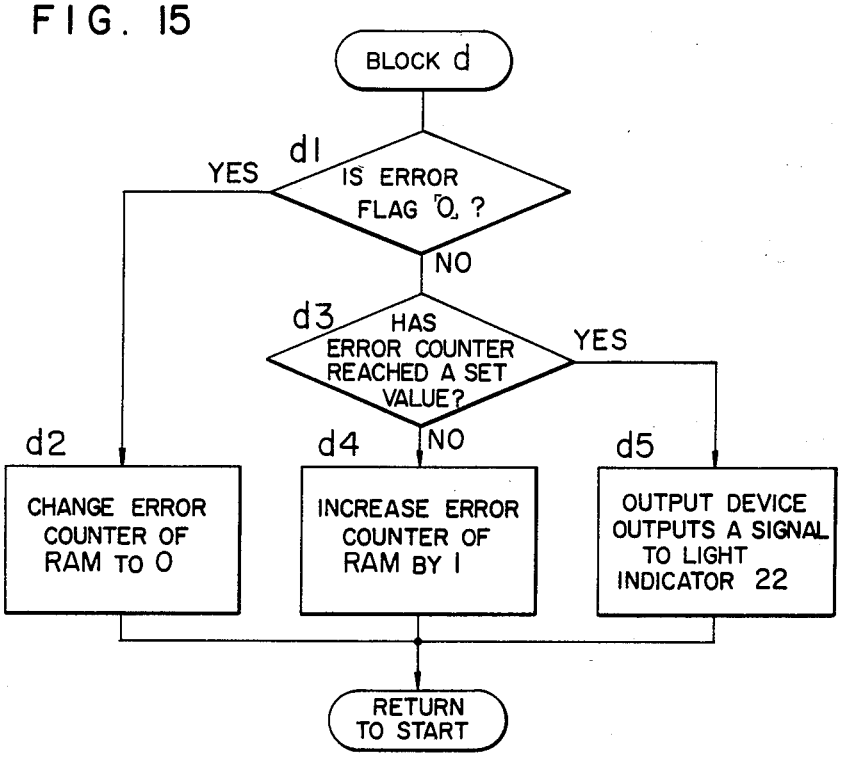
FIGS. 14 and 15 are flow charts of the detailed procedures of the blocks c and d, respectively, shown in the flow chart of FIG. 13.

Operation of the control unit will now be described by referring to the flow charts shown in FIGS. 13–15. First, the operation signal X and displacement signal Y are stored in a RAM through a multiplexor and an A/D converter of the control unit (block a in FIG. 13). Then, the drive for the swash plate 4 is controlled (block b in FIG. 13). The details of the procedures followed in effecting control of the drive of the swash plate 4 are similar to those shown in FIG. 5 and described by referring to the first embodiment.

Figure 13:
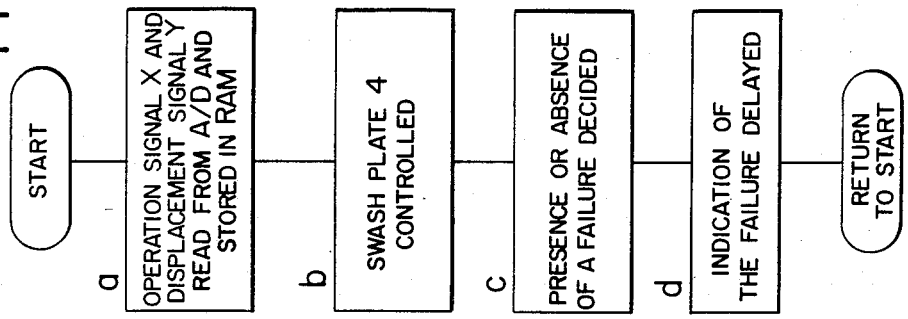
FIG. 13 is a flow chart of the operation of the control unit of the third embodiment of the failure detection system for hydraulic pumps in conformity with the invention as worked by using a microcomputer.
Figure 14:
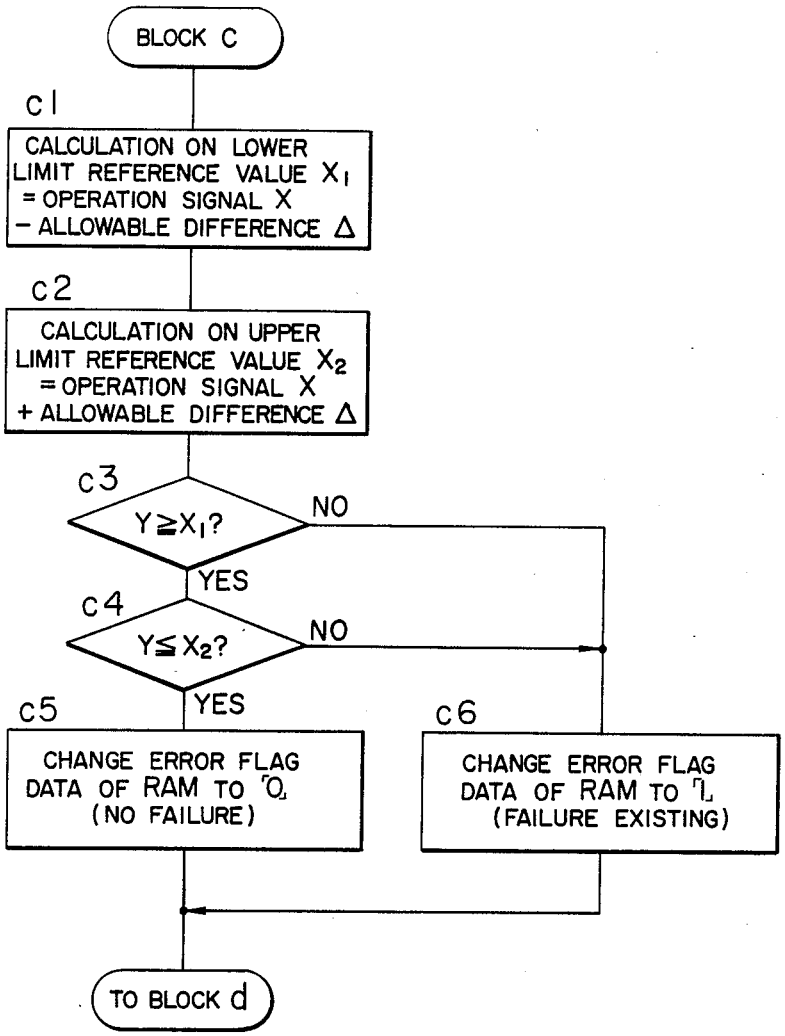

Thereafter, whether or not the pump 2 is out of order is determined (block c in FIG. 13). The details of the procedures followed in block c are shown in FIG. 14. In block c, the lower limit reference value $X_1$ and upper limit reference value $X_2$ are first obtained from the operation signal X (blocks c1 and c2). They are compared with the displacement signal Y to find out whether or not $Y \geqq X_1$ and $Y \leqq X_2$ (blocks c3 and c4). The procedures followed in blocks c1–c4, are entirely the same as those followed in blocks c1–c4 shown in FIG. 6 described by referring to the first embodiment.

When the signal Y is found to be above the lower limit reference value $X_1$ in block c3 and when it is found to be below the upper limit reference value $X_2$ in block c4, the operation shifts to block c5. In block c5, error flag data to be stored in a predetermined address of the RAM is changed to "0". In this case, it is when the displacement signal Y is found to be in the predetermined range in blocks c3 and c4 that the error flag data is "0". This means that the pump 2 is free from failure. Meanwhile, when the signal Y is found to be below the lower limit reference value $X_1$ in block c3 or when it is found to be above the upper limit reference value $X_2$ in block c4, the operation shifts to block c6. In block c6, the error data flag is changed to "1" which indicates that the displacement signal Y is not within a predetermined range and the pump 2 is out of order.

Then, the operation shifts to the procedures of delaying the indication of the failure. The procedures which are similar to those followed with regard to the delay circuit 40 of the third embodiment shown in FIG. 11 are shown in FIG. 15 in which the error flag data is retrieved from the RAM and checked to see if its value is "0". If the error flag data is found to be "0", the value of an error counter set at a predetermined address of the RAM is changed to "0" (block d2). In this specification, the term "error counter" designates a counter for counting a delay time that is set, and the counter is added with 1 each time the procedures of blocks a–d are followed once. Since the procedures followed in block d3 are those which are followed when there is no failure of the pump 2, this means that a delay is not needed and the value of the error counter is changed to "0".

When the error flag data is found not to be "0" in block d1, the value of the error counter in the RAM is retrieved and checked to see if it reaches the value set beforehand (block d3). If the value is below the value set beforehand or a predetermined delay time has not passed, 1 is added to the value of the error counter of the RAM (block d4), and the procedures of block a and the following are repeated again. When the value is found to have reached the value set beforehand in block d3, or when it is found that the predetermined delay time has already passed, the output device produces an output signal to activate the light emitting diode 22 to emit light (block d5).

In the operations described hereinabove, when the operation lever 10 is suddenly actuated and the swash plate 4 is unable to follow up the operation of the operation lever 10, the procedures of block c6 are followed to change the error flag data to "1", and the procedures of blocks d1, d3 and d4 are followed. However, the value set beforehand for the error counter is set in such a manner that a period of time longer than the period of time necessary for the swash plate 4 to catch up with the sudden and quick operation of the operation lever 10 is provided. Thus, the swash plate 4 catches up with the operation lever 10 and follows up its operation within the set value, so that the procedures of blocks c5, d1 and d2 are followed at a point in time at which the swash plate 4 catches up with the operation lever 10. Thus, no failure signal is outputted to the light emitting diode 22. Meanwhile, when the pump 2 is continuously out of order, the procedures of blocks c6, d1, d3 and d4 are repeatedly followed, so that 1 is added to the error counter each time the procedures are followed, until the set value is reached when procedures of block d5 are followed to produce a failure signal.

In this embodiment, the same advantage is offered by the provision of the delay circuit as in the previous embodiment when the failure signal produced by the output device is used for actuating emergency pump shutdown means.

Accordingly, in the embodiment worked by using a microcomputer, the provision of the delay circuit makes it possible to avoid the production of a temporary failure signal produced by error due to a failure of the swash plate 4 to follow up the operation of the operation lever 10 and to produce a failure signal only when the pump is mechanically or functionally out of order.

In each of the embodiments shown and described hereinabove, the operation signal has been described as being taken out of the operation lever. However, the invention is not limited to this specific form of operation signal and the operation signal may be in the form of a command signal given to the swash plate drive to indicate a final position of the swash plate.

From the foregoing, it will be appreciated that in the failure detection system according to the invention, the difference between an operation signal and a displacement signal is obtained and its absolute value is compared with a predetermined allowable value so as to produce an output signal indicating that the hydraulic pump is out of order when the predetermined allowable value is exceeded by the absolute value of the difference. Thus, the invention offers the advantages that it is possible to monitor at least one hydraulic pump at all times and automatically and promptly detect a failure of the pump without requiring mounting of a tester by cutting off hydraulic fluid piping and without the risk of foreign matter being incorporated in the hydraulic fluid for driving the pump. It is one of the features of the invention that a plurality of hydraulic pumps can be monitored simultaneously to detect their failure.

What is claimed is:

1. A failure detection system for hydraulic pumps each having displacement varying means, comprising:

displacement command generating means for generating a command value for causing the displacement varying means of one of the pumps to be displaced a predetermined amount;

sensor means for sensing the amount of a displacement of the displacement varying means of said one of the pumps;

comparator means in a failure detection circuit for comparing the absolute value of the difference between the command value generated by the displacement command generating means and an amount of the displacement sensed by the sensor means with a predetermined allowable value and for providing a signal indicating that the allowable value has been exceeded by the absolute value; and output means for outputting a failure signal for indicating that said one of the pumps is out of order when it is found by the comparator means that the allowable value has been exceeded by the absolute value.

2. A failure detection system as claimed in claim 1, wherein said comparator means comprise an addition means for adding the allowable value to the command value, a subtraction means for subtracting the allowable value from the command value, a first comparator means for outputting a signal when the amount of the displacement sensed by the sensor means exceeds a value obtained by adding the allowable value to the command value at the addition means; and a second comparator means for outputting a signal when the amount of the displacement sensed by the sensor means is less than a value obtained by subtracting the allowable value from the command value at the addition means.

3. A failure detection system as claimed in claim 2, wherein said output means comprises an OR circuit for producing the failure signal when the signal is outputted by one of the first and second comparator means.

4. A failure detection system as claimed in claim 1, further comprising limiter means for limiting the changing rate of the command value generated by the displacement command generating means to a level below the maximum displacement rate of the displacement varying means, and wherein said comparator means have inputted thereto a command value that has passed through the limiter means.

5. A failure detection system as claimed in claim 4, wherein said limiter means comprises a filter circuit.

6. A failure detection system as claimed in claim 1, further comprising delay means operative to produce a final failure signal only when the failure signal of the output means is continuously produced longer than a predetermined period of time.

7. A failure detection system as claimed in claim 6, wherein said delay means comprises an inverter circuit for inverting the failure signal of the output means, a pulse generating circuit for generating pulses of a predetermined period, an AND circuit having inputted thereto outputs of said pulse generating circuit and inverter circuit, and a triggerable monostable multivibrator triggered by an output of said AND circuit.

* * * * *